US005443169A

United States Patent [19]

Pagel et al.

[11] Patent Number: 5,443,169

[45] Date of Patent: Aug. 22, 1995

[54] CRANE BACKHITCH

[75] Inventors: Gene Pagel, Two Rivers; Charles Pick, Manitowoc; Mark Roloff, Two Rivers, all of Wis.

[73] Assignee: The Manitowoc Company

[21] Appl. No.: 945,140

[22] Filed: Sep. 15, 1992 (Under 37 CFR 1.47)

[51] Int. Cl.[6] ..... B66C 23/42

[52] U.S. Cl. ..... 212/298; 212/294

[58] Field of Search ..... 212/186, 182, 187, 239, 212/262

[56] References Cited

U.S. PATENT DOCUMENTS

| | | | |
|---|---|---|---|
| 2,348,285 | 5/1944 | Ekbom et al. | 212/186 |
| 2,509,435 | 5/1950 | Huttinger . | |
| 2,602,551 | 7/1952 | White . | |
| 2,738,884 | 3/1956 | Callouette et al. . | |
| 2,774,484 | 12/1956 | White . | |
| 2,795,338 | 6/1957 | Blanchard et al. | 212/186 |
| 2,813,636 | 11/1957 | Preston . | |
| 2,986,407 | 5/1961 | Krueger . | |
| 3,092,260 | 6/1963 | Noll et al. | 212/186 |
| 3,223,250 | 12/1965 | Noll et al. | 212/186 |
| 3,251,479 | 5/1966 | Lonngren . | |
| 3,278,045 | 10/1966 | Potter et al. . | |
| 3,335,877 | 8/1967 | Pezzini | 212/186 |
| 3,485,383 | 12/1969 | Beduhn . | |
| 3,777,900 | 12/1973 | Brewer . | |
| 3,977,530 | 8/1976 | Helm et al. . | |
| 4,081,081 | 3/1978 | Morrow, Sr. et al. . | |
| 4,169,535 | 10/1979 | Bryan, Jr. . | |
| 4,349,115 | 9/1982 | Lampson . | |
| 4,579,234 | 4/1986 | Delago et al. . | |
| 4,608,743 | 9/1986 | Stewart . | |
| 4,953,722 | 9/1990 | Becker et al. . | |

FOREIGN PATENT DOCUMENTS

| | | |
|---|---|---|
| 1956920 | 5/1971 | Germany . |
| 10202 | 8/1910 | United Kingdom . |

OTHER PUBLICATIONS

Brochure for a Manitowoc Model No. 4000W Crane—Copyright 1976.

Brochure for a Manitowoc Model No. 4100W Crane—Copyright 1976.

Brochure for a Manitowoc Model No. M-80W Crane—Copyright 1989.

Brochure for a Manitowoc Model No. M-50W Crane—Copyright 1991.

*Primary Examiner*—Michael S. Huppert
*Assistant Examiner*—Thomas J. Brahan
*Attorney, Agent, or Firm*—Willian Brinks Hofer Gilson & Lione

[57] ABSTRACT

A crane gantry assembly includes a gantry pivotally connected to a crane bed, a backhitch pivotally connected to the gantry and detachably connected to the crane bed, and a control link pivotally connected to the backhitch and to the crane bed. The control link is used when maneuvering the backhitch between raised and retracted positions, such as when the crane is set up or taken down for transport.

16 Claims, 3 Drawing Sheets

CRANE BACKHITCH

BACKGROUND OF THE INVENTION

This invention relates generally to the field of load-lifting cranes, and more particularly to a backhitch for such cranes.

The increased load-lifting capacities required of modern cranes have resulted in a large increase in crane size. Usually, this necessitates cranes being disassembled into smaller components for transport to jobsites. Crane disassembly and re-assembly is a difficult task due to the long crane booms and complex rigging systems typically encountered. The crane components, (i.e. the boom, gantry, backhitch, rigging, etc.), must be assembled and aligned correctly for the crane to operate safely and effectively.

A number of backhitches have been designed to help facilitate and simplify the task of assembling and disassembling cranes. Two of those designs are discussed in the following paragraphs.

Folding link backhitch designs are characterized by the backhitch having a folding portion therein. The folding portion of the backhitch rotates and folds to allow the gantry assembly to be lowered. The gantry assembly of this design, however, is unstable during initial lowering.

Telescopic backhitch designs are also known in the crane art. Often, the backhitch of these designs are formed of three separate links. The lower links, i.e. those closest to the crane bed, vertically telescope within a tubular structure on the crane bed or within themselves by means of, usually, a hydraulic cylinder. This telescopic movement causes the upper links of the backhitch and gantry to raise. This design is expensive, due to the numerous telescoping links and the hydraulic cylinders required, and is sometimes unstable due to the difficulty of balancing the hydraulic fluid flow to the cylinders on each backhitch leg.

SUMMARY OF THE INVENTION

A crane gantry assembly is provided including a gantry having a first end and a second end, the first end of the gantry pivotally connected to a crane bed; a backhitch having an upper end and a lower end, the upper end of the backhitch pivotally connected to the second end of the gantry, the lower end of the backhitch detachably connected to the crane bed; and a control link having a top end and a bottom end, the top end of the control link pivotally connected to the backhitch, the bottom end of the control link pivotally connected to the crane bed, the control link being operative to maneuver the backhitch between raised and retracted positions when the lower end of the backhitch is disconnected from the crane bed.

The present invention allows the gantry assembly to be maneuvered between operational and stored positions in a smooth and stable fashion. The control link accurately guides the backhitch to the position where the backhitch is connected to the crane bed.

The invention itself, together with further advantages, will be best understood by reference to the following detailed description taken in conjunction with the accompanying drawings.

DETAILED DESCRIPTION OF THE PRESENTLY PREFERRED EMBODIMENTS

As an initial matter, it should be noted that cranes typically include a gantry with two legs positioned adjacent one another on a crane bed. The gantry is supported by a backhitch having two vertical legs spaced approximately equal to the spacing of the gantry legs. In the side views of the crane described below, only one leg of each of the gantry and backhitch is shown.

Figure 1:
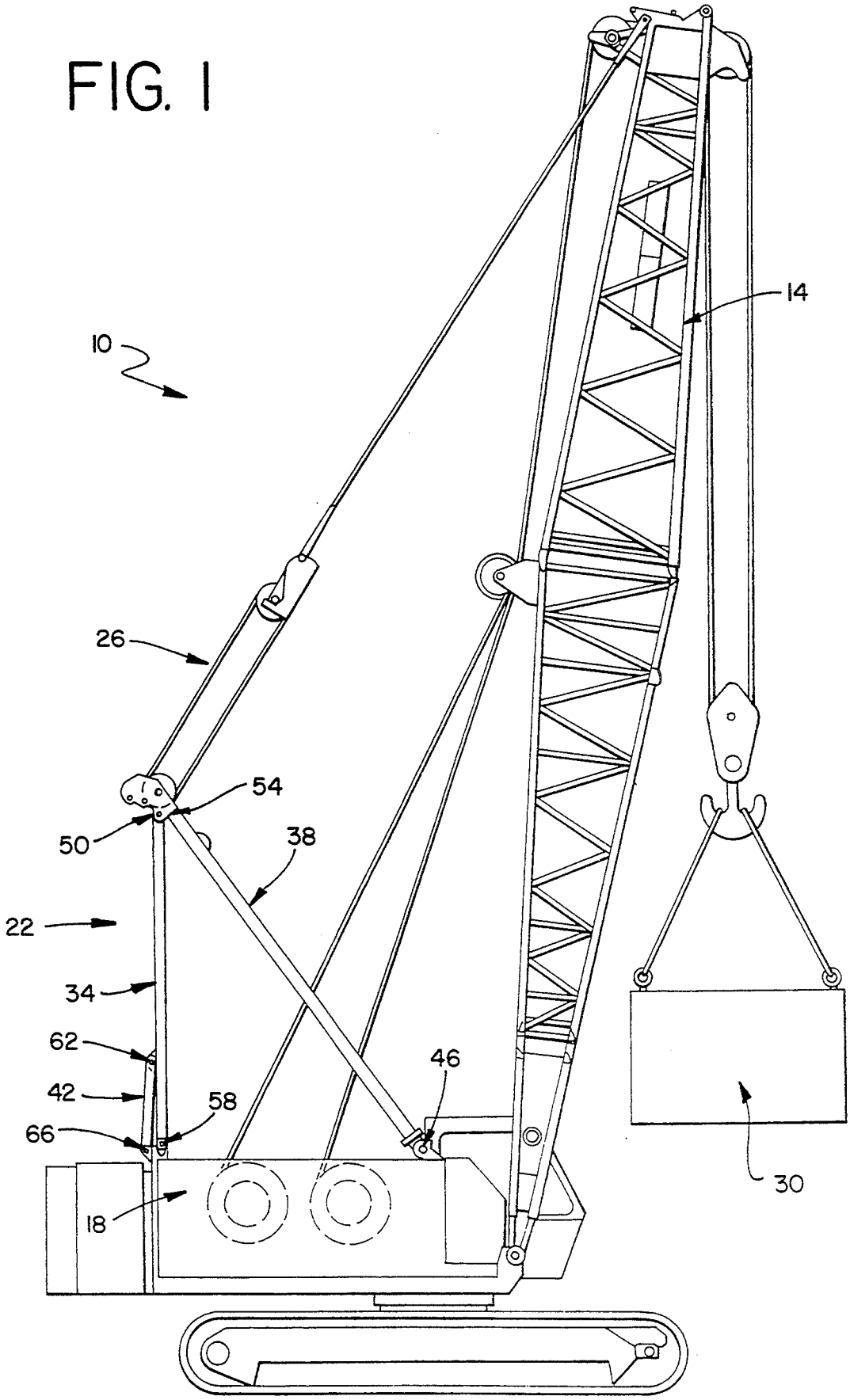
FIG. 1 is an elevational view of a crane incorporating a presently preferred embodiment of the backhitch of the present invention.

Turning now to the drawings, there is shown in FIG. 1 a crane 10 including a boom 14, a crane bed 18, and a gantry assembly 22 incorporating the presently preferred embodiment of the invention. The gantry assembly 22, via rigging system 26, supports the boom 14 and, thus, the load 30 being lifted by the crane 10. The rigging system 26 is linked to a third drum (not shown) positioned on the crane bed 18.

Figure 2:
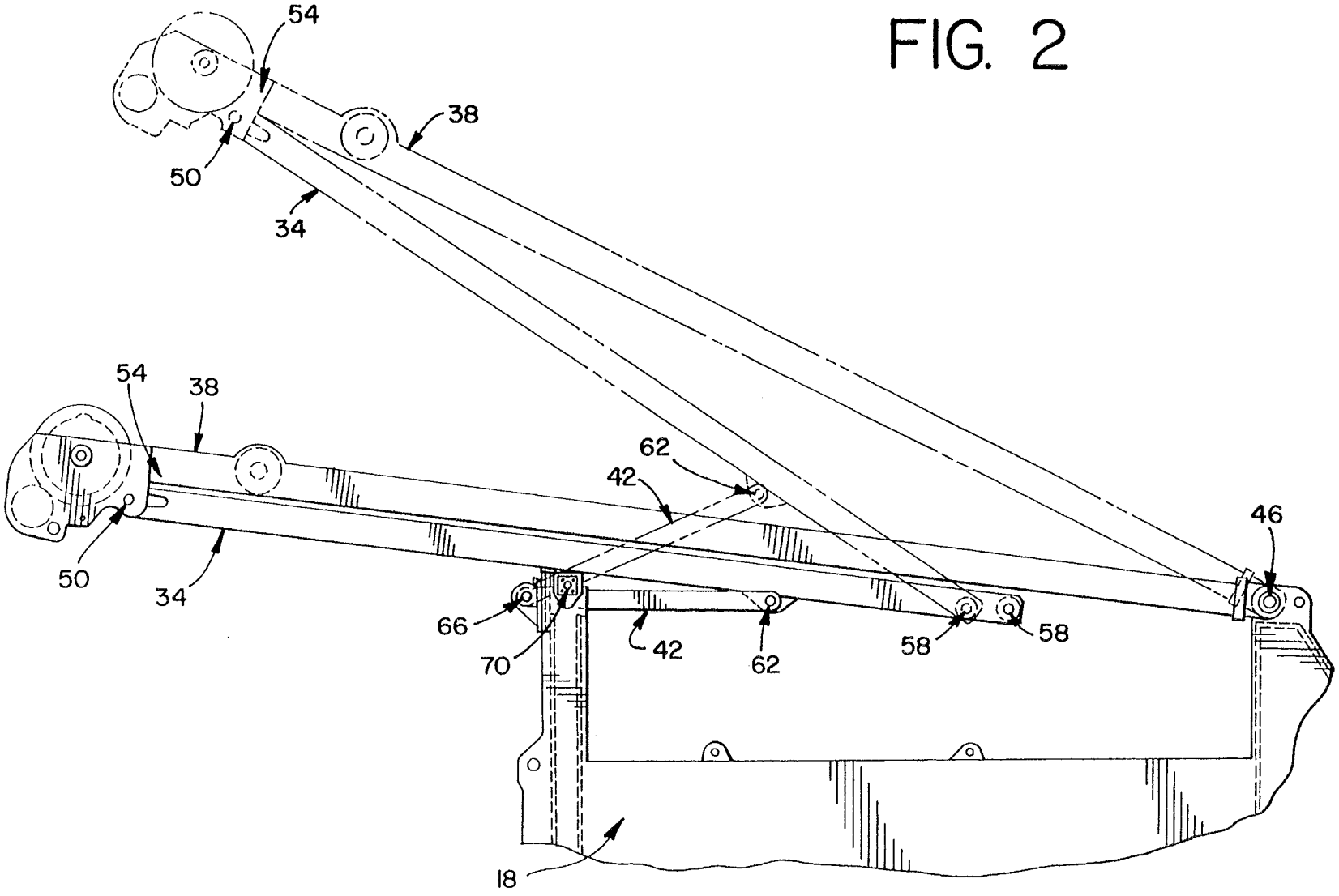
FIG. 2 is an enlarged view of the gantry assembly of FIG. 1 showing the gantry assembly in a retracted position and, in dashed lines, an intermediate position.
Figure 4:
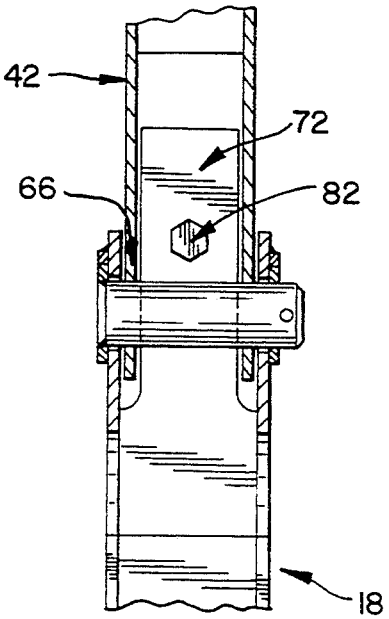
FIG. 4 is a cross-sectional view taken along line 4—4 of FIG. 3.

As best shown in FIGS. 1 and 2, the gantry assembly 22 includes a backhitch 34, a mast or gantry 38, and a control link 42. A second control link (not shown) operates on the opposite side of the gantry assembly 22. The gantry 38 has a first end 46 pivotally connected to the crane bed 18. The backhitch 34 has an upper end 50 pivotally connected to a second end 54 of the gantry 38 and a lower end 58 detachably connected to the crane bed 18. Finally, the control link 42 has a top end 62 pivotally connected to the backhitch 34 and a bottom end 66 pivotally connected to the crane bed 18, as shown in FIG. 4.

The lower end 58 of the backhitch 34 is detachably connected to the crane bed 18 by any suitable means. However, a removable pin 68 is preferred. The remaining pivotal connections discussed above may be of any design suitable to the application.

The backhitch 34 and the gantry 38 of the gantry assembly 22 may be of any suitable material and design, including a telescoping design. Preferably, however, the backhitch 34 and the gantry 38 are unitary structural members.

When the crane 10 is taken down for transport to another jobsite, the gantry assembly 22 is first retracted to a position as shown in FIG. 2 and then unrigged from the boom 14. In this position, the gantry 38 rests atop the backhitch 34 and the backhitch 34 is supported by the crane bed 18.

Figure 5:
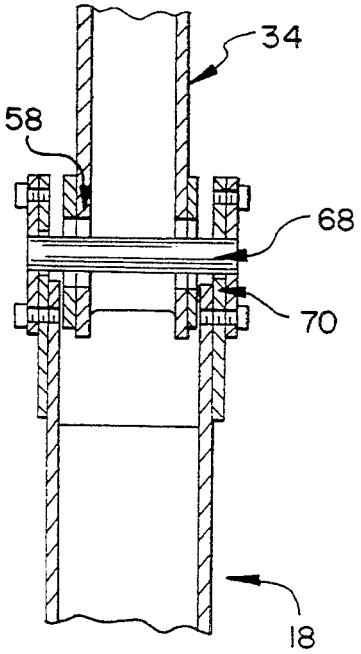
FIG. 5 is a cross-sectional view taken along line 5—5 of FIG. 3.

To retract the gantry assembly 22, the lower end 58 of the backhitch 34 is disconnected from the crane bed 18. In the preferred embodiment, this is done by removing the removable, connecting pin 68, as best shown in FIG. 5. The pin 68 may be inserted and removed by any suitable means. Preferably, however, the pin 68 is actuated by an air cylinder (not shown) mounted on the crane bed 18. It must be emphasized that only the backhitch 34 is disconnected during the retraction, and subsequent raising, of the gantry assembly 22. The connections between the backhitch 34 and the gantry 38, and the gantry 38 and the crane bed 18, remain secure.

After the backhitch 34 and the crane bed 18 are disengaged, the weight of the gantry assembly 22 causes the control link 42 to rotate in a clockwise direction. The eccentric placement of the connection points between the control link 42 and the backhitch 34 and the crane bed 18 assures a smooth movement of the backhitch 34 from an upright position to a stored position. This movement prompts the lower end 58 of the backhitch 34 to swing to the right, as shown in FIG. 2, and results in the backhitch 34 and the gantry 38 being lowered. The rotational movement of the control link 42 ceases when the retracted position is attained. In moving the gantry assembly 22 from a raised position to a retracted position, the control link 42 rotates through an angle of no more than about 90 degrees.

Once the crane 10 has been transported to a jobsite, the gantry assembly 22 is raised. This operation moves the control link 42 in a counter-clockwise direction. This rotational movement causes the lower end 58 of the backhitch 34 to move to the left and results in the backhitch 34 being raised. The control link 42 guides the lower end 58 of the backhitch 34 to the connection point 70 where the backhitch 34 is connected to the crane bed 18.

Figure 3:
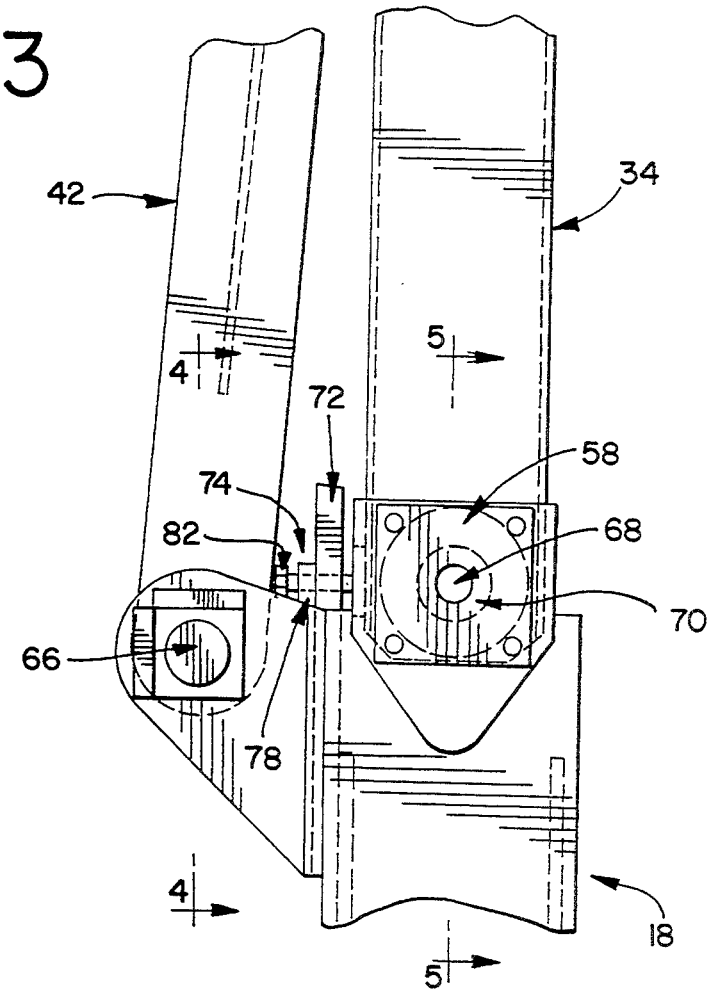
FIG. 3 is an enlarged partial view of the control link and the backhitch of FIG. 1.

Furthermore, as best shown in FIGS. 3 and 4, the control link 42 may further include a stop 72 for preventing the lower end 58 of the backhitch 34 from being raised past the connection point 70. The lower end 58 of the backhitch 34 contacts the stop 72 when the backhitch 34 reaches the connection point 70. The stop 72 may comprise any means suitable for the application. In the preferred embodiment, however, the stop 72 includes an adjustable bolt assembly 74 located between the crane bed 18 and the lower end 58 of the backhitch 34. The adjustable bolt assembly 74 comprises a lock nut 78 turned on a bolt 82. The bolt 82 may be turned in or out and locked with the lock nut 78 to adjust the stop position, i.e. the position where the lower end 58 of the backhitch 34 contacts the stop 72.

The present invention has the advantage of being able to maneuver the gantry assembly 22 between operational and stored positions in a smooth and stable manner. When stored, the gantry 38 rests atop the backhitch 34 in a compact fashion. Furthermore, the control link 42 accurately guides the backhitch 34 to the position where the backhitch 34 is connected to the crane bed 18.

It should be appreciated that the backhitch of this invention may be configured as appropriate for the application. The embodiment described above is to be considered in all respects as illustrative and not restrictive. The scope of the invention is indicated by the following claims rather than by the foregoing description. All changes which come within the meaning and range of equivalency of the claims are to be embraced within their scope.

We claim:

1. A gantry assembly for a crane, comprising:

a) a gantry having a first end and a second end, the first end of the gantry pivotally connected to a crane bed;

b) a backhitch having an upper end and a lower end, the upper end of the backhitch pivotally connected to the second end of the gantry, the lower end of the backhitch detachably connected to the crane bed; and c) a control link having a top end and a bottom end, the top end of the control link pivotally connected to the backhitch, the bottom end of the control link pivotally connected to the crane bed, the control link operative to rotate while guiding the backhitch between raised and retracted positions when the lower end of the backhitch is disconnected from the crane bed, the backhitch remaining pivotally connected to the control link in the raised and retracted positions.

2. The gantry assembly of claim 1 wherein the lower end of the backhitch is detachably connected to the crane bed by a removable pin.

3. The gantry assembly of claim 1 wherein the gantry rests atop the backhitch when the backhitch is guided by the control link to a retracted position.

4. The gantry assembly of claim 1 further comprising a stop that prevents the backhitch from moving past a connection point where the lower end of the backhitch connects to the crane bed when the gantry assembly is raised.

5. The gantry assembly of claim 4 wherein the stop comprises an adjustable bolt assembly located between the crane bed and the lower end of the backhitch, the lower end of the backhitch contacting the adjustable bolt assembly when it is aligned with the crane bed connection point.

6. The gantry assembly of claim 5 wherein the adjustable bolt assembly comprises:

a) a lock nut; and b) a bolt adjustably disposed through the lock nut for varying the position where the lower end of the backhitch contacts the stop.

7. The gantry assembly of claim 1 wherein the control link rotates through an angle of not more than about 90° when the backhitch is guided between a raised and a retracted position.

8. A control link assembly for maneuvering a crane gantry assembly comprising a backhitch having an upper end pivotally connected to a gantry and a lower end detachably connected to a crane bed, the control link assembly comprising:

a) a control link having a top end and a bottom end, the top end of the control link pivotally connected to the backhitch, the bottom end of the control link pivotally connected to the crane bed, the control link operative to rotate while guiding the backhitch to raised and retracted positions when the lower end of the backhitch is disconnected from the crane bed, the backhitch remaining pivotally connected to the control link in the raised and retracted positions; and b) a stop for preventing the gantry assembly from being raised past a connection point where the lower end of the backhitch connects to the crane bed.

9. The control link assembly of claim 8 wherein the lower end of the backhitch is detachably connected to the crane bed by a removable pin.

10. The control link assembly of claim 8 wherein the gantry rests atop the backhitch when the backhitch is guided by the control link to a retracted position.

11. The control link assembly of claim 8 wherein the stop comprises an adjustable bolt assembly located between the crane bed and the lower end of the backhitch, the lower end of the backhitch contacting the adjustable bolt assembly when it is aligned with the crane bed connection point.

12. The control link assembly of claim 11 wherein the adjustable bolt assembly comprises:

a) a lock nut; and b) a bolt adjustably disposed through the lock nut for varying the position where the lower end of the backhitch contacts the stop.

13. The control link assembly of claim 8 wherein the control link rotates through an angle of not more than about 90° when guiding the backhitch between a raised and a retracted position.

14. A crane comprising:

a) a crane bed;

b) a crane boom pivotally connected to the crane bed;

c) a gantry having a first end and a second end, the first end of the gantry pivotally connected to the crane bed;

d) a backhitch having an upper end and a lower end, the upper end of the backhitch pivotally connected to the second end of the gantry, the lower end of the backhitch detachably connected to the crane bed; ad e) a control link having a top end and a bottom end, the top end of the control link pivotally connected to the backhitch, the bottom end of the control link pivotally connected to the crane bed, the control link operative to rotate while guiding the backhitch between raised and retracted positions when the lower end of the backhitch is disconnected from the crane bed, the backhitch remaining pivotally connected to the control link in the raised and retracted positions.

15. The crane of claim 14 wherein the control link rotates through an angle of not more than 90° when the backhitch is guided between a raised and a retracted position.

16. The crane of claim 14, further comprising a stop that prevents the backhitch from moving past a connection point where the lower end of the backhitch connects to the crane bed.

* * * * *

UNITED STATES PATENT AND TRADEMARK OFFICE

CERTIFICATE OF CORRECTION

PATENT NO. : 5,443,169

DATED : August 22, 1995

INVENTOR(S) : Gene Pagel et al.

It is certified that error appears in the above-indentified patent and that said Letters Patent is hereby corrected as shown below:

In the Claims

Col. 6, claim 14, line 2, delete "ad" and substitute --and--.

Signed and Sealed this

Twenty-fourth Day of June, 1997

Bruce Lehman

*Attest:*

BRUCE LEHMAN

*Attesting Officer*

*Commissioner of Patents and Trademarks*